US012111097B2

(12) United States Patent
Toyooka et al.

(10) Patent No.: US 12,111,097 B2
(45) Date of Patent: Oct. 8, 2024

(54) REFRIGERATION APPARATUS

(71) Applicant: PHC HOLDINGS CORPORATION, Tokyo (JP)

(72) Inventors: Takashi Toyooka, Saitama (JP); Minoru Suto, Gunma (JP); Fumihiro Asayama, Ehime (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 316 days.

(21) Appl. No.: 17/580,338

(22) Filed: Jan. 20, 2022

(65) Prior Publication Data

US 2022/0146185 A1 May 12, 2022

Related U.S. Application Data

(63) Continuation of application No. PCT/JP2020/024673, filed on Jun. 23, 2020.

(30) Foreign Application Priority Data

Jul. 22, 2019 (JP) ..... 2019-134600

(51) Int. Cl.
*F25D 23/06* (2006.01)
*F25D 11/02* (2006.01)

(52) U.S. Cl.
CPC ..... *F25D 23/061* (2013.01); *F25D 11/02* (2013.01)

(58) Field of Classification Search
CPC ..... F25D 23/061; F25D 11/02; F25D 11/04; F25D 2323/06; F25B 7/00; F25B 39/02; F25B 6/04; F25B 2339/023
See application file for complete search history.

(56) References Cited

U.S. PATENT DOCUMENTS

2009/0126389 A1* 5/2009 Takasugi ..... F25B 9/006 62/335
2011/0023532 A1* 2/2011 Kobayashi ..... F25D 23/025 62/524

(Continued)

FOREIGN PATENT DOCUMENTS

JP 03158683 A * 7/1991 ..... F25D 17/04
JP H 03158683 A * 7/1991 ..... F25D 17/04

(Continued)

OTHER PUBLICATIONS

PDF is translation of foreign reference JP 03158683 A (Year: 1991).*

(Continued)

*Primary Examiner* — Len Tran
*Assistant Examiner* — Kamran Tavakoldavani
(74) *Attorney, Agent, or Firm* — Rimon P.C.

(57) ABSTRACT

This refrigeration apparatus comprises: an inner box having a top surface and side surfaces; and an evaporator constituted by bent pipes comprising a top surface portion in contact with the top surface, an upper side-surface portion in contact with the side surfaces, and a lower side-surface portion in contact with the side surfaces below the upper-side surface portion. The pipes constituting the upper side-surface portion are more densely arranged than the pipes constituting the lower side-surface portion. The total length of the pipes constituting the top surface portion and the upper side-surface portion is 62.5% or more of the lengths of the pipes in contact with the inner box.

5 Claims, 4 Drawing Sheets

(56) References Cited

U.S. PATENT DOCUMENTS

| | | | | |
|---|---|---|---|---|
| 2011/0197623 | A1 | 8/2011 | Ascani et al. | |
| 2013/0047659 | A1* | 2/2013 | Kim | F25D 11/022 62/441 |
| 2019/0376737 | A1 | 12/2019 | Toyooka et al. | |

FOREIGN PATENT DOCUMENTS

| | | | |
|---|---|---|---|
| JP | 2002-372357 | A | 12/2002 |
| JP | 2005-083665 | A | 3/2005 |
| JP | 2009-162425 | A | 7/2009 |
| JP | 2011-047557 | A | 3/2011 |
| JP | 2019-007668 | A | 1/2019 |
| KR | 20-0311817 | | 5/2003 |
| KR | 20-2011-0005993 | U | 6/2011 |
| WO | 2018/216464 | A1 | 11/2018 |

OTHER PUBLICATIONS

PDF is translation of foreign reference JPH 03158683 A (Year: 1991).*

International Search Report issued in corresponding International Patent Application No. PCT/JP2020/024673, dated Aug. 18, 2020, with English translation.

* cited by examiner

REFRIGERATION APPARATUS

CROSS-REFERENCE OF RELATED APPLICATIONS

This application is a Continuation of International Patent Application No. PCT/JP2020/024673, filed on Jun. 23, 2020, which in turn claims the benefit of Japanese Application No. 2019-134600, filed on Jul. 22, 2019, the entire disclosures of which Applications are incorporated by reference herein.

TECHNICAL FIELD

The present disclosure relates to a refrigeration apparatus.

BACKGROUND ART

A refrigeration apparatus includes a compressor, a condenser, a decompressor, and an evaporator in order to set the inside of the cooling chamber to a target temperature. For example, PTL 1 discloses a refrigeration apparatus in which an evaporator composed of a refrigerant pipe is disposed in a bent state at the outer side of the top, bottom, left and right, and rear walls of the inner box.

CITATION LIST

Patent Literature

PTL 1
Japanese Patent Application Laid-Open No. 2019-007668

SUMMARY OF INVENTION

Technical Problem

When cooling the inside of the cooling chamber to a target temperature with the refrigeration apparatus disclosed in PTL 1, the temperature of the entirety of the inside of the cooling chamber cannot be set to the target temperature, and the temperature inside the cooling chamber may become uneven in some situation. The greater the volume of the cooling chamber, the more likely the temperature inside the cooling chamber become uneven. When the temperature inside the cooling chamber becomes uneven, the object may not be stored at the target temperature depending on the location where object is placed.

Under such a circumstance, an object of the present disclosure is to provide a refrigeration apparatus that can evenly distribute the temperature inside the cooling chamber.

Solution to Problem

A refrigeration apparatus according to the present disclosure includes: an inner box with a top surface, a side surface, and a bottom surface; an evaporator that is a pipe disposed outside the inner box and is a bent pipe, the pipe including a top surface part in contact with the top surface, an upper side surface part in contact with the side surface, and a lower side surface part in contact with the side surface at a position lower than the upper side surface part; and a two-way refrigeration circuit including: a high-temperature side refrigeration circuit including a high-temperature side evaporator, a heat exchanger forming a cascade heat exchanger together with the high-temperature side evaporator, and a low-temperature side refrigeration circuit including the evaporator, wherein an internal space of the inner box forms a cooling chamber surrounded by the upper side surface part and the lower side surface part, wherein a pipe forming the upper side surface part and the lower side surface part includes a plurality of pipe parts arranged at even intervals in a vertical direction, wherein a pipe forming the upper side surface part is more densely disposed than a pipe forming up the lower side surface part, wherein a sum of lengths of a pipe forming the top surface part and the pipe forming the upper side surface part is equal to or greater than 62.5% of a length of the pipe in contact with the inner box, and wherein a length of a pipe in contact with the bottom surface is smaller than 8.0% of the length of the pipe in contact with the inner box.

Advantageous Effects of Invention

With the refrigeration apparatus according to the present disclosure, it is possible to evenly distribute the temperature inside the cooling chamber.

DESCRIPTION OF EMBODIMENTS

An embodiment of the present disclosure is described in detail below with reference to the accompanying drawings. Note that the embodiment described below is merely an example, and the present disclosure is not limited to the present embodiment.

Figure 1:
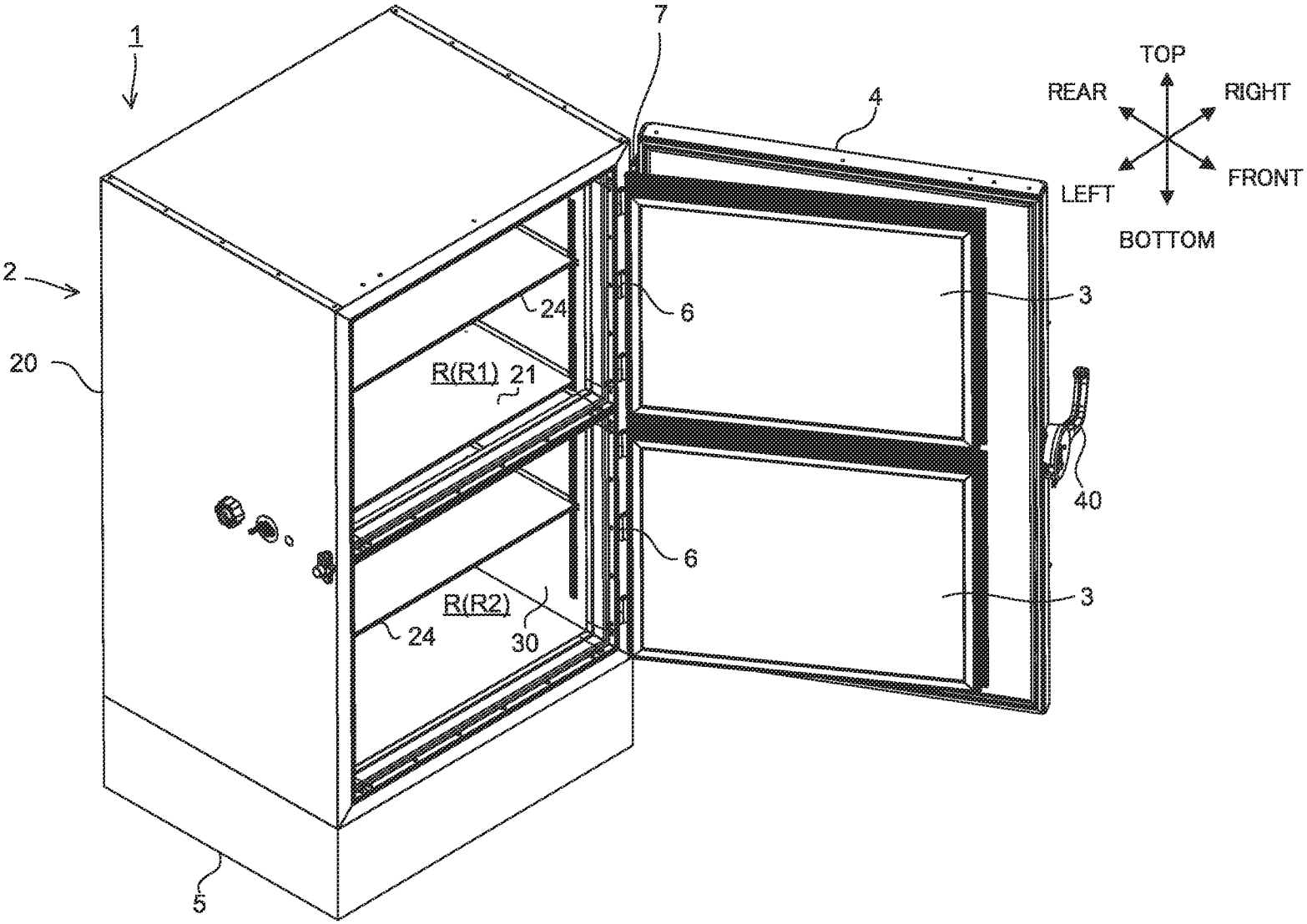
FIG. 1 is a perspective view illustrating an external appearance of a refrigeration apparatus according to the present disclosure.

FIG. 1 is a perspective view illustrating an external appearance of refrigeration apparatus 1 according to the present disclosure. Refrigeration apparatus 1 is, for example, an ultra-low-temperature freezer in which the cooling chamber has an inner temperature of −80° C. or below. In addition, in the present specification, the side that the user using it faces (the side on which the outer door and inner door described later are disposed) is the front side of refrigeration apparatus 1, and the side opposite to the front side is the rear side of refrigeration apparatus 1. In addition, the left side and right side as viewed from the front side is the left side and right side of refrigeration apparatus 1.

Refrigeration apparatus 1 includes housing 2, inner door 3, outer door 4, and machine chamber 5.

Housing 2 includes outer box 20, inner box 30, heat insulation material 300 (see FIG. 4) and the like. Inner box 30 is located inside outer box 20, and heat insulation material 300 is provided between outer box 20 and inner box 30 (see FIG. 4).

The internal space of inner box 30 is cooling chamber R, which is a space to house an object. Cooling chamber R is partitioned by partition plate 21 into upper cooling chamber R1 and lower cooling chamber R2 aligned in the upper and lower sides. Note that ventilation is enabled between upper cooling chamber R1 and lower cooling chamber R2. As illustrated in FIG. 1, upper cooling chamber R1 and lower cooling chamber R2 are further partitioned by partition plate 24 into two upper and lower sections. Ventilation is enabled between the upper and lower chambers of upper cooling chamber R1, and ventilation is enabled also between the upper and lower chambers in lower cooling chamber R2.

One inner door 3 is provided for each of upper cooling chamber R1 and lower cooling chamber R2. Each inner door 3 is fixed to the right end part of housing 2 with a plurality of hinges 6 in an openable and closable manner.

Outer door 4 is fixed to the right end part of housing 2 with hinge 7 in an openable and closable manner on the outside (i.e., right side) of inner door 3. In addition, outer door 4 is provided with handle 40 that is grabbed by the user to open or close outer door 4.

Machine chamber 5 is provided in a lower portion of housing 2, and high-temperature side compressor 111 and low-temperature side compressor 121 that are included in refrigeration circuit 101 described later are disposed in machine chamber 5 (see FIG. 4).

Figure 2:
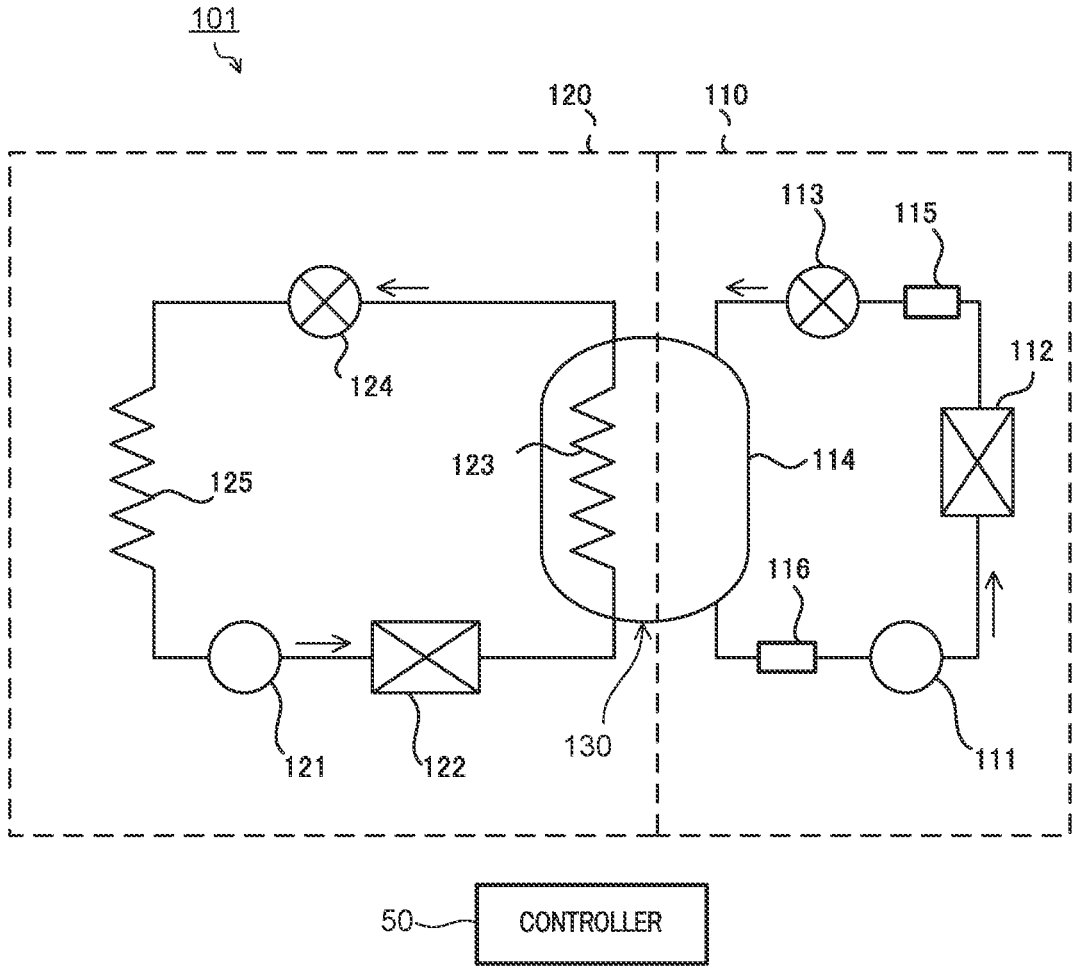
FIG. 2 is a diagram illustrating a refrigeration circuit provided in the refrigeration apparatus according to the present disclosure.

FIG. 2 is a diagram illustrating refrigeration circuit 101 provided in refrigeration apparatus 1 according to the present disclosure. Refrigeration circuit 101 is a two-way refrigeration circuit including high-temperature side refrigeration circuit 110 and low-temperature side refrigeration circuit 120 that circulate refrigerant independently of each other.

High-temperature side refrigeration circuit 110 includes high-temperature side compressor 111, high-temperature side condenser 112, high-temperature side decompressor 113, high-temperature side evaporator 114, dryer 115, and liquid receiver 116.

High-temperature side evaporator 114 is the outer pipe of cascade heat exchanger 130 described later, and surrounds second heat exchanger 123 described later.

The above-mentioned devices are connected through a predetermined pipe (high-temperature side pipe) such that the refrigerant (high-temperature side refrigerant) discharged from high-temperature side compressor 111 again returns to high-temperature side compressor 111. The high-temperature side refrigerant circulates in the arrow direction of FIG. 2. Specifically, in high-temperature side refrigeration circuit 110, the high-temperature side refrigerant flows through high-temperature side compressor 111, high-temperature side condenser 112, dryer 115, high-temperature side decompressor 113, high-temperature side evaporator 114, and liquid receiver 116 in this order, and returns back to high-temperature side compressor 111. Note that the temperature of the low-temperature side refrigerant can be reduced to approximately −40° C. at high-temperature side evaporator 114 through the freezing cycle in high-temperature side refrigeration circuit 110.

Low-temperature side refrigeration circuit 120 includes low-temperature side compressor 121, first heat exchanger 122, second heat exchanger 123, low-temperature side decompressor 124, and low-temperature side evaporator 125.

First heat exchanger 122 cools the refrigerant passing through its inside in the gas phase. Note that first heat exchanger 122 may be a condenser that condenses the refrigerant passing through its inside.

Second heat exchanger 123 is the inner pipe of cascade heat exchanger 130. Specifically, second heat exchanger 123 serving as the inner pipe is surrounded by high-temperature side evaporator 114 serving as the outer pipe. In cascade heat exchanger 130, the heat is exchanged between the low temperature refrigerant passing inside high-temperature side evaporator 114 and the high temperature refrigerant passing inside second heat exchanger 123. At this time, the high temperature refrigerant passing inside second heat exchanger 123 condenses. Note that in the case where first heat exchanger 122 is a condenser, second heat exchanger 123 cools the refrigerant in the liquid phase passing through its inside.

Low-temperature side evaporator 125 is, for example, a pipe made of copper or aluminum. As described later, low-temperature side evaporator 125 is disposed at least partially in contact with the outer surface of inner box 30. Thus, when the refrigerant evaporates inside low-temperature side evaporator 125, the outer surface of inner box 30 in contact with low-temperature side evaporator 125 is cooled, and in turn, cooling chamber R is cooled.

The above-mentioned devices are connected through a predetermined pipe (low-temperature side pipe) such that the refrigerant (low-temperature side refrigerant) discharged from low-temperature side compressor 121 again returns to low-temperature side compressor 121. The low-temperature side refrigerant circulates in the arrow direction of FIG. 1. Specifically, in low-temperature side refrigeration circuit 120, the low-temperature side refrigerant flows through low-temperature side compressor 121, first heat exchanger 122, second heat exchanger 123, low-temperature side decompressor 124, and low-temperature side evaporator 125 in this order, and returns back to low-temperature side compressor 121. Note that an ultra-low temperature of −80° C. or below can be obtained at low-temperature side evaporator 125 through the freezing cycle in low-temperature side refrigeration circuit 120.

Refrigeration apparatus 1 includes controller 50. Controller 50 controls, in order to set an input target temperature, the operation of high-temperature side compressor 111 and low-temperature side compressor 121 to set the temperature inside cooling chamber R to the target temperature.

Figure 3:
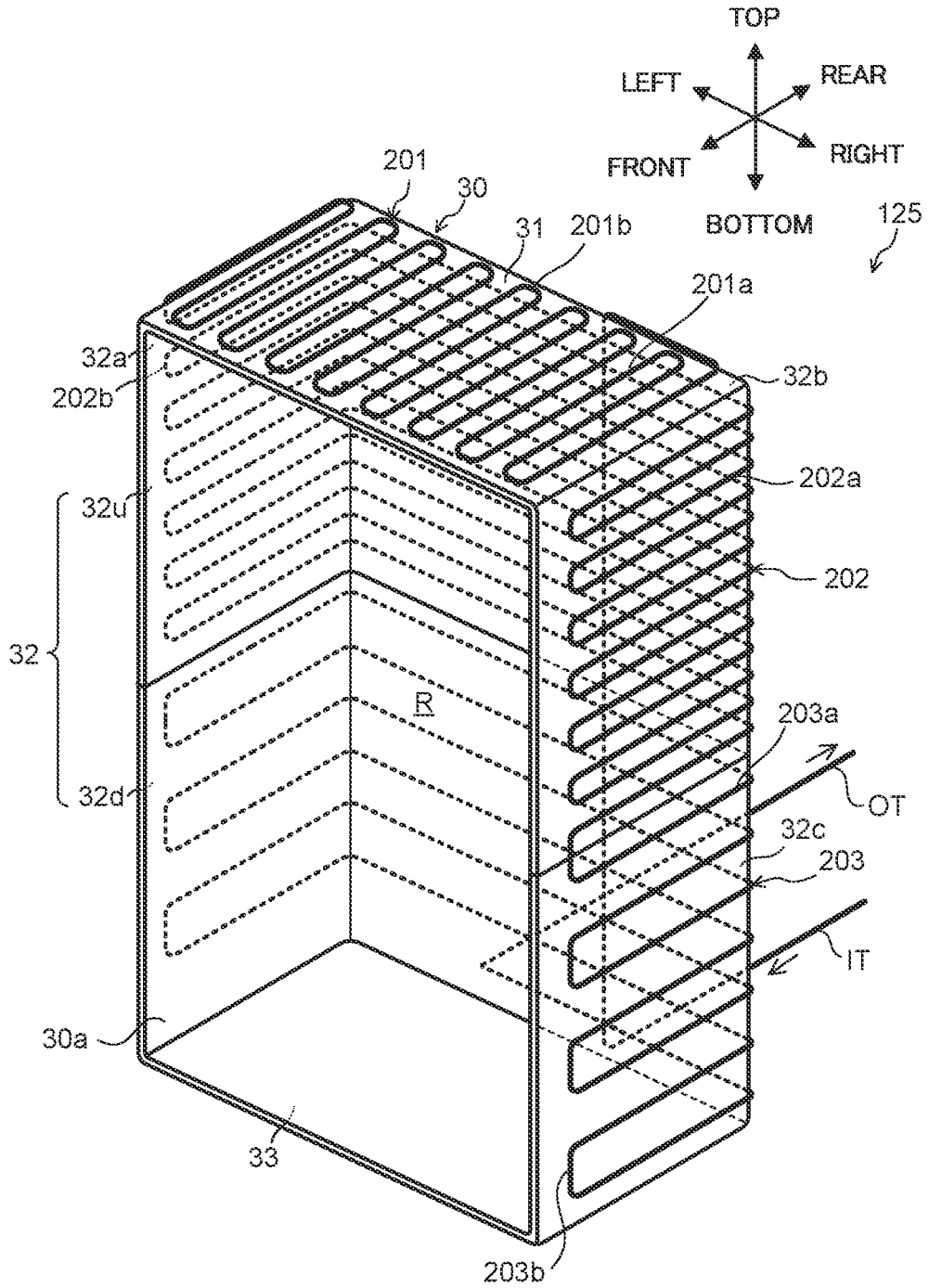
FIG. 3 is a diagram illustrating an evaporator provided in the refrigeration apparatus according to the present disclosure.

FIG. 3 is a diagram illustrating low-temperature side evaporator 125 provided in refrigeration apparatus 1 according to the present disclosure.

Inner box 30 illustrated in FIG. 3 has a vertically long cuboid shape with opening 30*a* in the front surface.

Inner box 30 surrounds cooling chamber R. Inner box 30 includes top surface 31, side surface 32, and bottom surface 33. The inner surfaces of top surface 31 and bottom surface 33 form upper and lower surfaces of cooling chamber R, respectively. Side surface 32 includes left surface 32*a*, back surface 32*b*, and right surface 32*c*. Left surface 32*a*, back surface 32*b* and right surface 32*c* form the left, rear and right surfaces of cooling chamber R, respectively.

Side surface 32 may be sectioned into upper side surface 32*u* and lower side surface 32*d*. Upper side surface 32*u* surrounds the periphery of upper cooling chamber R1 together with top surface 31, and lower side surface 32*d* surrounds the periphery of lower cooling chamber R2 together with bottom surface 33.

Low-temperature side evaporator 125 is a bent pipe that is disposed partially in contact with the outer surface of inner box 30. Note that low-temperature side refrigerant flows in the direction indicated with the arrow in FIG. 3.

Low-temperature side evaporator 125 includes inlet pipe IT, top surface part 201, upper side surface part 202, lower side surface part 203, and outlet pipe OT.

Inlet pipe IT is connected to a pipe on the downstream side of low-temperature side decompressor 124. Inlet pipe IT includes a pipe part that comes close to back surface 32*b* from low-temperature side decompressor 124, a pipe part that extends in the vertical direction in the vicinity of back surface 32*b* of inner box 30, and a pipe part that extends in a left-right direction in the vicinity of top surface 31. Note that inlet pipe IT is not connected to the outer surface of inner box 30. In addition, inlet pipe IT is connected to top surface part 201.

Top surface part 201 is disposed in contact with top surface 31. Top surface part 201 includes a plurality of pipe parts 201*a* and a plurality of pipe parts 201*b* alternately connected to each other. The plurality of pipe parts 201*a* extends in the front-rear direction and the plurality of pipe parts 201*b* extends in the left-right direction. The size in the left-right direction of pipe part 201*b* that connects two pipe parts 201*a* corresponds to the pitch of pipe parts 201*a*. Top surface part 201 is connected to upper side surface part 202.

Upper side surface part 202 is a pipe disposed in contact with side surface 32. Upper side surface part 202 includes a plurality of pipe parts 202*a* extending in the horizontal direction and a plurality of pipe parts 202*b* extending in the vertical direction. Pipe part 202*a* includes a pipe extending along left surface 32*a* in the front-rear direction, a pipe extending along back surface 32*b* in the left-right direction, and a pipe extending along right surface 32*c* in the front-rear direction. Pipe part 202*a* and pipe part 202*b* are alternately connected to each other, and the size in the vertical direction of pipe part 202*b* connecting two pipe parts 202*a* corresponds to the pitch of pipe parts 202*a*. Upper side surface part 202 is connected to lower side surface part 203.

Lower side surface part 203 is a pipe disposed in contact with side surface 32 at a position on the downward side of upper side surface part 202. Lower side surface part 203 includes a plurality of pipe parts 203*a* extending in the horizontal direction, and a plurality of pipe parts 203*b* extending in the vertical direction. Pipe part 203*a* includes a pipe extending along left surface 32*a* in the front-rear direction, a pipe extending along back surface 32*b* in the left-right direction, and a pipe extending along right surface 32*c* in the front-rear direction. Pipe part 203*a* and pipe part 203*b* are alternately connected to each other, and the size in the vertical direction of pipe part 203*b* that connects two pipe parts 203*a* corresponds to the pitch of pipe parts 203*a*. Lower side surface part 203 is connected to outlet pipe OT.

Outlet pipe OT is connected to the pipe on the upstream side of low-temperature side compressor 121. Note that outlet pipe OT is not in contact with the outer surface of inner box 30.

Figure 4:
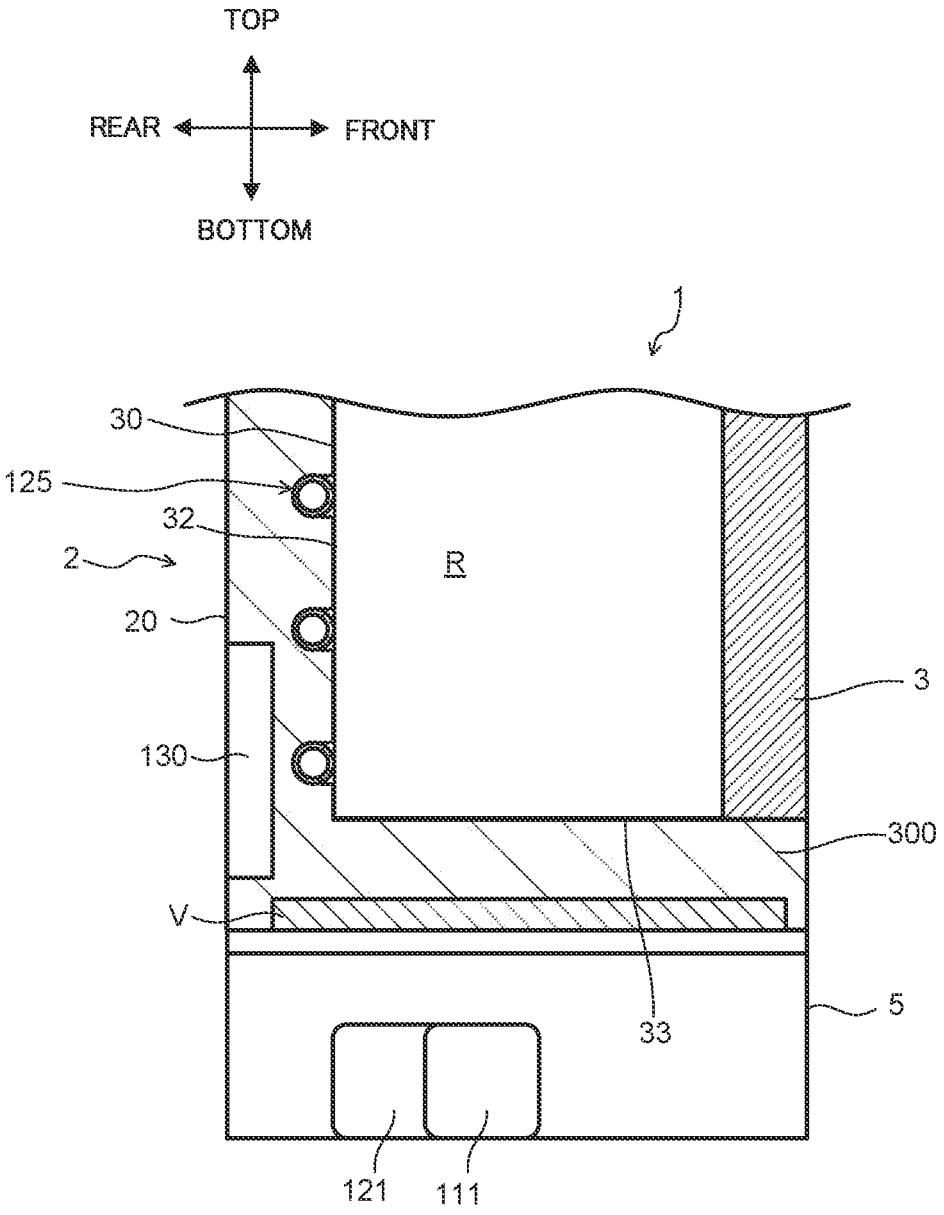
FIG. 4 is a schematic view illustrating a vertical cross-section of the refrigeration apparatus according to the present disclosure.

FIG. 4 is a schematic view illustrating a vertical cross-section of refrigeration apparatus 1 according to the present disclosure.

As described above, heat insulation material 300 is provided inside housing 2, i.e., between outer box 20 and inner box 30 so as to surround top surface 31, side surface 32, and bottom surface 33 of inner box 30. Heat insulation material 300 is, for example, urethane foam.

Cascade heat exchanger 130 is disposed on the rear side between outer box 20 and inner box 30. A vacuum insulation panel (VIP) V is disposed on the lower side of the inside of housing 2, i.e., the lower side of bottom surface 33. Vacuum heat insulating panel V is disposed so as to cover at least the entire region of the orthogonal projection of bottom surface 33 to the bottom surface of outer box 20. That is, at least one of the top surface or bottom surface of vacuum heat insulating panel V has an area equal to or greater than the area of bottom surface 33. Vacuum heat insulating panel V has a lower thermal conductivity than heat insulation material 300. Vacuum heat insulating panel V blocks the heat that goes toward bottom surface 33 from below.

A part of the pipe forming refrigeration circuit 101, high-temperature side compressor 111 and low-temperature side compressor 121 and the like are disposed in machine chamber 5 on the lower side of housing 2.

A pipe that makes up low-temperature side evaporator 125 is described in detail below.

The pipe forming upper side surface part 202 is more densely disposed than the pipe forming lower side surface part 203. In other words, the pitch of pipe parts 202*a* is smaller than the pitch of pipe parts 203*a*. In addition, the pipe forming top surface part 201 is more densely disposed than the pipe forming lower side surface part 203. In other words, the pitch of pipe parts 201*a* is smaller than the pitch of pipe parts 203*a*.

Table 1 shows the ratio of the length of each portion in contact with the outer surface of inner box 30 of low-temperature side evaporator 125 of refrigeration apparatus 1 according to the present embodiment and the refrigeration apparatus of known example 1. The refrigeration apparatus according to known example 1 differs from refrigeration apparatus 1 according to the present embodiment only in arrangement of low-temperature side evaporator 125. Note that the total length in Table 1 is the length of the pipe in contact with the outer surface of inner box 30 in low-temperature side evaporator 125. In addition, the bottom surface part is a part of low-temperature side evaporator 125, and is a pipe disposed in contact with bottom surface 33. Note that in the refrigeration apparatus of known example 1, the bottom surface part is disposed between lower side surface part 203 and outlet pipe OT. Specifically, lower side surface part 203 is in contact with the bottom surface part, and the bottom surface part is in contact the outlet pipe OT. In the following description, the pipe in contact with the outer surface of inner box 30 in low-temperature side evaporator 125 is referred to as contact pipe.

TABLE 1

| Portion of low-temperature side evaporator | Known example 1 Ratio (%) | Present embodiment Ratio (%) |
|---|---|---|
| Top surface part | 18.5 | 18.8 |
| Upper side surface part | 43.9 | 52.6 |
| Lower side surface part | 29.7 | 28.6 |
| Bottom surface part | 8.0 | 0 |
| Total length | 100 | 100 |

In the refrigeration apparatus of known example 1, the ratio of the sum of the pipe lengths of top surface part 201 and upper side surface part 202 with respect to the total length of the contact pipe is 62.4 (=18.5+43.9)%. In refrigeration apparatus 1 according to the present embodiment, the ratio of the sum of the pipe lengths of top surface part 201 and upper side surface part 202 with respect to the total length of the contact pipe is 71.4 (=18.8+52.6)%. That is, in refrigeration apparatus 1 according to the present embodiment, the contact pipe is disposed in a concentrated manner on the upper side of inner box 30, i.e., on the upper side of top surface 31 and side surface 32 in comparison with the refrigeration apparatus of known example 1.

In addition, in the refrigeration apparatus of known example 1, the ratio of the length of the pipe forming upper side surface part 202 with respect to the total length of the contact pipe is 43.9%. In refrigeration apparatus 1 according to the present embodiment, the ratio of the length of the pipe that forming upper side surface part 202 with respect to the total length of the contact pipe is 52.6%. That is, in refrigeration apparatus 1 according to the present embodiment, the contact pipe is disposed in a concentrated manner on the upper side of side surface 32 in comparison with the refrigeration apparatus of known example 1.

In addition, in the refrigeration apparatus of known example 1, the ratio of the length of the pipe forming top surface part 201 with respect to the total length of the contact pipe is 18.5%. In refrigeration apparatus 1 according to the present embodiment, the ratio of the length of the pipe forming top surface part 201 with respect to the total length of the contact pipe is 18.8%. That is, in refrigeration apparatus 1 according to the present embodiment, low-temperature side evaporator 125 is disposed at top surface 31 such that the ratio of the length of top surface part 201 with respect to the total length of the contact pipe is approximately equal to or greater than the ratio of the length of top surface part 201 with respect to the total length of the contact pipe in the refrigeration apparatus of known example 1.

In addition, in the refrigeration apparatus of known example 1, the ratio of the length of the pipe forming the bottom surface part with respect to the total length of the contact pipe is 8.0%. In refrigeration apparatus 1 according to the present embodiment, the ratio of the length of the pipe forming the bottom surface part with respect to the total length of the contact pipe is 0%. That is, in refrigeration apparatus 1 according to the present embodiment, low-temperature side evaporator 125 is disposed such that low-temperature side evaporator 125 does not make contact with bottom surface 33.

In the known refrigeration apparatus, when the temperature of cooling chamber R is to be reduced to the target temperature set by the user, the cold air tends to accumulate on the lower side of cooling chamber R, and the temperature on the lower side tends to be lower than the temperature on the upper side in cooling chamber R. Consequently, the actual temperature inside cooling chamber R tends to be uneven. However, in the present embodiment, the pipe of upper side surface part 202 is more densely disposed than the pipe of lower side surface part 203 as described above, and the length of the pipe forming top surface part 201 and upper side surface part 202 is 71.4% of the total length of the contact pipe. With low-temperature side evaporator 125 disposed in a concentrated manner on the upper side of inner box 30 in this manner, the upper side of cooling chamber R is easily cooled. Thus, the temperature inside cooling chamber R is more evenly distributed.

In addition, in the present embodiment, the length of the pipe forming upper side surface part 202 is 52.6% of the length of the contact pipe. With low-temperature side evaporator 125 concentrated on the upper side of side surface 32 in this manner, the upper side of cooling chamber R is more easily cooled, and the temperature inside cooling chamber R is more evenly distributed.

Further, in the present embodiment, the length of the pipe forming top surface part 201 is 18.8% of the length of the contact pipe. With low-temperature side evaporator 125 disposed in a constant ratio also at top surface 31 in this manner, the upper side of cooling chamber R is more easily cooled, and the temperature inside cooling chamber R is more evenly distributed.

In the present embodiment, low-temperature side evaporator 125 does not have the bottom surface part. Specifically, low-temperature side evaporator 125 is disposed without making contact with bottom surface 33. Thus, cooling chamber R is less cooled from the lower side, and the temperature inside the cooling chamber is further evenly distributed.

In the case where low-temperature side evaporator 125 has the bottom surface part as the case of the known refrigeration apparatus, the pipe forming the bottom surface part is located on the most lower side among the pipes in contact with inner box 30. As a result, the lubricating oil associated with the refrigerant tends to retain inside the pipe forming the bottom surface part. However, in the present embodiment, since low-temperature side evaporator 125 is not in contact with bottom surface 33, the lubricating oil less retains inside low-temperature side evaporator 125.

According to the present embodiment, vacuum heat insulating panel V with a lower thermal conductivity than heat insulation material 300 is disposed on the upper side of high-temperature side compressor 111 and low-temperature side compressor 121, and on the lower side of bottom surface 33 of inner box 30. Thus, it is possible to more effectively prevent the heating of bottom surface 33 due to the heat of apparatuses that can be the heat source such as high-temperature side compressor 111 and low-temperature side compressor 121. In particular, in the above-described embodiment, the ratio of the length of the pipe of the bottom surface part with respect to the total length of the contact pipe is small in comparison with the known refrigeration apparatus, and therefore the temperature of the bottom surface 33 is more likely to be increased when the heat of high-temperature side compressor 111 and low-temperature side compressor 121 is received. Thus, it is technically meaningful to dispose vacuum heat insulating panel V on the lower side of bottom surface 33 of inner box 30 to obtain the heat insulating effect in comparison with the known refrigeration apparatus.

Note that as a result of an extensive experiment conducted by the present inventors, it was confirmed that the temperature inside cooling chamber R can be more evenly distributed even when low-temperature side evaporator 125 is not in contact with the outer surface of inner box 30 with the ratio shown in Table 1. That is, surprisingly, it was confirmed that the temperature inside cooling chamber R can be more evenly distributed when the ratio of the sum of the pipe lengths of top surface part 201 and upper side surface part 202 with respect to the total length of the contact pipe is a value greater than 62.4%, which is the ratio of the sum of the pipe lengths of top surface part 201 and upper side surface part 202 with respect to the total length of the contact pipe in known example 1, i.e., when the ratio is 62.5% or greater.

In addition, surprisingly, it was confirmed that the temperature inside cooling chamber R can be more evenly distributed when the ratio of the length of the pipe of upper side surface part 202 with respect to the total length of the contact pipe is a value greater than 43.9%, which is the ratio of the length of the pipe of upper side surface part 202 with respect to the total length of the contact pipe in known example 1, i.e., when the ratio is 44.0% or greater.

In addition, surprisingly, it was confirmed that the temperature inside cooling chamber R can be further evenly distributed by setting the ratio of the length of the pipe of upper side surface part 202 with respect to the total length of the contact pipe to 44.0% or greater, while setting the ratio of the length of the pipe with respect to the total length of the contact pipe of top surface part 201 to 18% or greater to obtain the evenly distributed temperature inside cooling chamber R.

In addition, in the related art, it has been believed that cooling should be performed also from bottom surface 33 side to some degree in order to evenly cool the inside of cooling chamber R. However, surprisingly, as a result of the experiments conducted by the present inventors, it was confirmed that the temperature inside cooling chamber R is more evenly distributed by not performing the cooling from the lower side as much as possible. To be more specific, it was confirmed that it is preferable to set the ratio of the length of the pipe of the bottom surface part to a value smaller than 8.0%, which is the ratio of the bottom surface part in known example 1, and it is more preferable to set the ratio of the length of the pipe of the bottom surface part to 0% as in the present embodiment, i.e., it is more preferable that bottom surface 33 do not make contact with low-temperature side evaporator 125.

Note that the ratio of the length of the pipe of the bottom surface part with respect to the total length of the contact pipe need not necessarily be 0%. That is, the lubricating oil less retains in low-temperature side evaporator 125 in comparison with the refrigeration apparatus of known example 1 as long as it is smaller than the ratio of the bottom surface part in known example 1. Note that the smaller the ratio of the bottom surface part with respect to the total length of the contact pipe, the less the lubricating oil retains in low-temperature side evaporator 125. Thus, the retention of the lubricating oil in low-temperature side evaporator 125 is smallest when low-temperature side evaporator 125 is disposed without making contact with bottom surface 33 as in the present embodiment.

Modification 1

Modification 1 is described below. In Modification 1 described below, the same configurations as those of the above-described embodiment are denoted by the same reference numerals to omit the descriptions, and the points different from the above-described embodiment are mainly described in the following description. Note that the modification is different from the above-described embodiment in the volume of inner box 30.

Table 2 shows the ratio of the length of each portion in contact with the outer surface of inner box 30 of low-temperature side evaporator 125 of a refrigeration apparatus of known example 2, and refrigeration apparatus 1 according to a modification. The refrigeration apparatus according to the known example 2 is different from refrigeration apparatus 1 according to the modification only in arrangement of low-temperature side evaporator 125.

TABLE 2

| Portion of low-temperature side evaporator | Known example 2 Ratio (%) | Modification Ratio (%) |
|---|---|---|
| Top surface part | 25.0 | 21.0 |
| Upper side surface part | 36.2 | 52.6 |
| Lower side surface part | 28.1 | 26.4 |
| Bottom surface part | 10.8 | 0 |
| Total length | 100 | 100 |

The ratio of the sum of the pipe lengths of top surface part 201 and upper side surface part 202 with respect to the total length of the contact pipe is 61.2 (=25.0+36.2)% in known example 2, and is 73.6 (=21.0+52.6)% in Modification 1.

The ratio of the length of the pipe of upper side surface part 202 with respect to the total length of the contact pipe is 36.2% in known example 2, and is 52.6% in Modification 1.

In addition, the ratio of the length of the pipe of top surface part 201 with respect to the total length of the contact pipe in Modification 1 is 21.0%.

In addition, the ratio of the length of the pipe of the bottom surface part with respect to the total length of the contact pipe is 10.8% in known example 2, and is 0% in Modification 1. That is, in Modification 1, low-temperature side evaporator 125 does not have the bottom surface part. In other words, in Modification 1, low-temperature side evaporator 125 is disposed at inner box 30 without making contact with bottom surface 33.

The temperature inside cooling chamber R of refrigeration apparatus 1 according to the modification is more even than the temperature inside the cooling chamber of the refrigeration apparatus according to the known example 2. That is, even when low-temperature side evaporator 125 is disposed in contact with inner box 30 to set the ratio shown in the modification of Table 2, effects similar to those of the above-described embodiment can be obtained.

Note that the pipe that makes up low-temperature side evaporator 125 needs to have a certain diameter to allow the refrigerant to smoothly flow in its inside. That is, the size reduction of the pipe is naturally limited. As such, at top surface part 201 and upper side surface part 202, the size reduction of the turning portion of the pipe laid in a meandering manner, i.e., the size reduction of the pitch of pipe part 201*a* and pipe part 202*a*, is also naturally limited. Therefore, the ratio of the sum of lengths of top surface part 201 and upper side surface part 202 with respect to the total length of the contact pipe is at most 90%. In addition, the ratio of the length of upper side surface part 202 with respect to the total length of the contact pipe is at most 80%.

In addition, in the case where the bottom surface of cooling chamber R can be formed with heat insulation material 300, inner box 30 may not include bottom surface 33.

In addition, the shape of inner box 30 need not necessarily be a vertically long cuboid, and may be a substantially cuboid or a laterally long cuboid; however, in the case where inner box 30 has a vertically long cuboid shape, the temperature difference between the upper side and the lower side of cooling chamber R tends to be large and the temperature of cooling chamber R tends to be uneven. In view of this, when inner box 30 has a vertically long cuboid shape, the effect of the present disclosure of evenly distributing the temperature inside cooling chamber R is more significant in comparison with the case where inner box 30 has other shapes. In addition, the greater the volume of inner box 30, the greater the unevenness in the temperature inside cooling chamber R. Therefore, the larger the volume of inner box 30, the more significant the effect of the present disclosure of evenly distributing the temperature inside cooling chamber R.

Note that in the present embodiment, refrigeration apparatus 1 includes a two-way refrigeration circuit as an example, but a refrigeration circuit other than the two-way refrigeration circuit may also be provided. For example, it is possible to adopt a refrigeration apparatus including only one refrigeration circuit including a compressor, a condenser, a decompressor and an evaporator. In addition, refrigeration apparatus 1 may be a refrigeration apparatus with two refrigeration circuits that cools the inside of cooling chamber R by using the evaporator provided in each refrigeration circuit. In this case, two pipes forming the evaporators are disposed in contact with the outer peripheral surface of inner box 30.

This application is a continuation of International Patent Application No. PCT/JP2020/024673, filed on Jun. 23, 2020, the disclosure of which is incorporated herein by reference in its entirety. International Patent Application No. PCT/JP2020/024673 is entitled to (or claims) the benefit of Japanese Patent Application No. 2019-134600, filed on Jul. 22, 2019, the disclosure of which is incorporated herein by reference in its entirety.

INDUSTRIAL APPLICABILITY

The refrigeration apparatus according to the present disclosure can be used as a refrigeration apparatus in which the temperature inside the cooling chamber is more even. Thus, its industrial applicability is wide.

REFERENCE SIGNS LIST

1 Refrigeration apparatus
2 Housing
3 Inner door
4 Outer door
5 Machine chamber
6, 7 Hinge
20 Outer box
21, 24 Partition plate
30 Inner box
30*a* Opening
31 Top surface
32 Side surface
32*a* Left surface
32*b* Back surface
32*c* Right surface
33 Bottom surface
40 Handle
50 Controller
101 Refrigeration circuit
110 High-temperature side refrigeration circuit
111 High-temperature side compressor
112 High-temperature side condenser
113 High-temperature side decompressor
114 High-temperature side evaporator
115 Dryer
116 Liquid receiver
120 Low-temperature side refrigeration circuit
121 Low-temperature side compressor
122 First heat exchanger
123 Second heat exchanger
124 Low-temperature side decompressor
125 Low-temperature side evaporator
130 Cascade heat exchanger
201 Top surface part
202 Upper side surface part
203 Lower side surface part
300 Heat insulation material
IT Inlet pipe
OT Outlet pipe
R Cooling chamber
R1 Upper cooling chamber
R2 Lower cooling chamber
V Vacuum heat insulating panel

The invention claimed is:

1. A refrigeration apparatus comprising:

an inner box with an internal space enclosed by a top surface, a side surface, and a bottom surface; and a two-way refrigeration circuit including a high-temperature side refrigeration circuit and a low-temperature side refrigeration circuit, which are configured to exchange heat with each other, wherein:

the internal space is partitioned by a partition plate into a plurality of cooling chambers, among which ventilation is enabled, the low-temperature side refrigeration circuit includes a low-temperature side evaporator that is a pipe disposed outside the inner box, the pipe including a top surface part in contact with the top surface, an upper side surface part in contact with the side surface, and a lower side surface part in contact with the side surface at a position lower than the upper side surface part so as to surround the internal space, the upper side surface part includes a plurality of pipe sections arranged at even intervals of a first pitch in a vertical direction, the lower side surface part includes a plurality of pipe sections arranged at even intervals of a second pitch greater than the first pitch in the vertical direction, the upper side surface part is directly connected to the lower side surface part at the side surface of the inner box, a sum of lengths of a pipe forming the top surface part and the pipe forming the upper side surface part is equal to or greater than 62.5% of a length of the pipe in contact with the inner box, and a length of a pipe in contact with the bottom surface is smaller than 8.0% of the length of the pipe in contact with the inner box.

2. The refrigeration apparatus according to claim 1, wherein the sum of the lengths of the pipe forming the top surface part and the pipe forming the upper side surface part is equal to or smaller than 90% of the length of the pipe in contact with the inner box.

3. The refrigeration apparatus according to claim 2, wherein the length of the pipe forming the upper side surface part is equal to or greater than 44.0% and equal to or smaller than 80% of the length of the pipe in contact with the inner box.

4. The refrigeration apparatus according to claim 1, wherein no part of the pipe of the low-temperature side evaporator is in contact with the bottom surface.

5. The refrigeration apparatus according to claim 1, further comprising:

a compressor disposed on a lower side of the inner box; and a vacuum heat insulating panel provided between the compressor and the inner box.

* * * * *